US007799495B2

(12) United States Patent
Wu et al.

(10) Patent No.: US 7,799,495 B2
(45) Date of Patent: Sep. 21, 2010

(54) METAL OXIDE OVERCOATED PHOTOCONDUCTORS

(75) Inventors: Jin Wu, Webster, NY (US); Kenny-Tuan Dinh, Webster, NY (US); John F Yanus, Webster, NY (US); Adal Tecleab, Cincinnati, OH (US); June Shujun Peng, Maple Valley, WA (US); Marc J Livecchi, Rochester, NY (US); Linda L Ferrarese, Rochester, NY (US); Edward C Savage, Webster, NY (US); Gary A Batt, Fairport, NY (US); John J Wilbert, Macedon, NY (US); Robert W Hedrick, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 421 days.

(21) Appl. No.: 12/059,689

(22) Filed: Mar. 31, 2008

(65) Prior Publication Data

US 2009/0246665 A1 Oct. 1, 2009

(51) Int. Cl.
*G03G 15/04* (2006.01)

(52) U.S. Cl. ..... 430/66; 430/58.8; 430/59.4; 430/59.5

(58) Field of Classification Search ..... 430/66, 430/58.8, 59.4, 59.5
See application file for complete search history.

(56) References Cited

U.S. PATENT DOCUMENTS

| | | | |
|---|---|---|---|
| 4,265,990 | A | 5/1981 | Stolka et al. |
| 4,298,697 | A | 11/1981 | Baczek et al. |
| 4,338,390 | A | 7/1982 | Lu |
| 4,555,463 | A | 11/1985 | Hor et al. |
| 4,560,635 | A | 12/1985 | Hoffend et al. |
| 4,587,189 | A | 5/1986 | Hor et al. |
| 4,921,773 | A | 5/1990 | Melnyk et al. |
| 5,473,064 | A | 12/1995 | Mayo et al. |
| 5,482,811 | A | 1/1996 | Keoshkerian et al. |
| 5,521,306 | A | 5/1996 | Burt et al. |
| 6,913,863 | B2 * | 7/2005 | Wu et al. ..... 430/58.8 |
| 7,037,631 | B2 * | 5/2006 | Wu et al. ..... 430/59.1 |

OTHER PUBLICATIONS

Liang-Bih Lin et al., U.S. Application No. (Not Yet Assigned) on Thiuram Tetrasulfide Containing Photogenerating Layer, filed concurrently herewith, Mar. 31, 2008.
Liang-Bih Lin et al., U.S. Application No. (Not Yet Assigned) on Benzothiazole Containing Photogenerating Layer, filed concurrently herewith, Mar. 31, 2008.
Jin Wu et al., U.S. Application No. (Not Yet Assigned) on Thiuram Tetrasulfide Containing Photogenerating Layer, filed concurrently herewith, Mar. 31, 2008.
Jin Wu et al., U.S. Application No. (Not Yet Assigned) on Additive Containing Photoconductors, filed concurrently herewith, Mar. 31, 2008.
Jin Wu et al., U.S. Application No. (Not Yet Assigned) on Carbazole Hole Blocking Layer Photoconductors, filed concurrently herewith, Mar. 31, 2008.
Jin Wu, U.S. Application No. (Not Yet Assigned) on Oxadiazole Containing Photoconductors, filed concurrently herewith, Mar. 31, 2008.
Jin Wu, U.S. Application No. (Not Yet Assigned) on Titanocene Containing Photoconductors, filed concurrently herewith, Mar. 31, 2008.
Jin Wu et al., U.S. Application No. (Not Yet Assigned) on Thiadiazole Containing Photoconductors, filed concurrently herewith, Mar. 31, 2008.
Jin Wu et al., U.S. Application No. (Not Yet Assigned) on Overcoat Containing Titanocene Photoconductors, filed concurrently herewith, Mar. 31, 2008.
Daniel Levy et al., U.S. Application No. (Not Yet Assigned) on Urea Resin containing Photogenerating Layer Photoconductors, filed concurrently herewith, Mar. 31, 2008.
John F. Yanus et al., U.S. Appl. No. 11/593,662 on Overcoated Photoconductors With Thiophosphate Containing Photogenerating Layer, filed Nov. 7, 2006.
Jin Wu et al., U.S. Appl. No. 11/961,549 on Photoconductors Containing Ketal Overcoats, filed Dec. 20, 2007.

* cited by examiner

*Primary Examiner*—John L Goodrow
(74) *Attorney, Agent, or Firm*—E. O. Palazzo

(57) ABSTRACT

A photoconductor containing a photogenerating layer, and at least one charge transport layer, and a top polymeric overcoat layer in contact with, and contiguous to the charge transport layer, and which overcoat layer includes an indium tin oxide.

29 Claims, No Drawings

METAL OXIDE OVERCOATED PHOTOCONDUCTORS

CROSS REFERENCE TO RELATED APPLICATIONS

U.S. Application No. 2009/0246658, filed concurrently herewith by Liang-Bih Lin et al. on Thiuram Tetrasulfide Containing Photogenerating Layer, the disclosure of which is totally incorporated herein by reference.

U.S. Application No. 2009/0246659, filed concurrently herewith by Liang-Bih Lin et al. on Benzothiazole Containing Photogenerating Layer, the disclosure of which is totally incorporated herein by reference.

U.S. Application No. 2009/0246662, filed concurrently herewith by Jin Wu et al. on Hydroxyquinoline Containing Photoconductors, the disclosure of which is totally incorporated herein by reference.

U.S. Application No. 2009/0246660, filed concurrently herewith by Jin Wu on Additive Containing Photoconductors, the disclosure of which is totally incorporated herein by reference.

U.S. Application No. 2009/0246668, filed concurrently herewith by Jin Wu on Carbazole Hole Blocking Layer Photoconductors, the disclosure of which is totally incorporated herein by reference.

U.S. Application No. 2009/0246664, filed concurrently herewith by Jin Wu on Oxadiazole Containing Photoconductors, the disclosure of which is totally incorporated herein by reference.

U.S. Application No. 2009/0246663, filed concurrently herewith by Jin Wu on Titanocene Containing Photoconductors, the disclosure of which is totally incorporated herein by reference.

U.S. Application No. 2009/0246666, filed concurrently herewith by Jin Wu et al. on Thiadiazole Containing Photoconductors, the disclosure of which is totally incorporated herein by reference.

U.S. Application No. 2009/0246657, filed concurrently herewith by Jin Wu et al. on Overcoat Containing Titanocene Photoconductors, the disclosure of which is totally incorporated herein by reference.

U.S. Application No. 2009/0246661, filed concurrently herewith by Daniel Levy et al. on Urea Resin Containing Photogenerating Layer Photoconductors, the disclosure of which is totally incorporated herein by reference.

U.S. application Ser. No. 11/593,662, filed Nov. 7, 2006, the disclosure of which is totally incorporated herein by reference, illustrates a photoconductor comprising an optional supporting substrate, a photogenerating layer, and at least one charge transport layer, and wherein the photogenerating layer contains at least one thiophosphate, and an overcoat layer in contact with and contiguous to the charge transport layer, and which overcoat layer is comprised of an acrylated polyol, a polyalkylene glycol, a crosslinking component, and a charge transport component.

U.S. application Ser. No. 11/961,549 filed Dec. 20, 2007 on Photoconductors Containing Ketal Overcoats, the disclosure of which is totally incorporated herein by reference, illustrates a photoconductor comprising a supporting substrate, a photogenerating layer, and at least one charge transport layer comprised of at least one charge transport component, and an overcoat layer in contact with and contiguous to the charge transport layer, and which overcoat is comprised of a crosslinked polymeric network, an overcoat charge transport component, and at least one ketal.

A number of the components and amounts thereof of the above copending application, such as the supporting substrates, resin binders, photogenerating layer components, antioxidants, charge transport components, hole blocking layer components, adhesive layers, and the like, may be selected for the photoconductive members of the present disclosure in embodiments thereof.

BACKGROUND

This disclosure is generally directed to layered imaging members, photoreceptors, photoconductors, and the like. More specifically, the present disclosure is directed to multilayered rigid, drum imaging members, or devices comprised of an optional supporting medium like a substrate, a photogenerating layer, a charge transport layer, including a plurality of charge transport layers, such as a first charge transport layer and a second charge transport layer, an optional adhesive layer, an optional hole blocking or undercoat layer, and a metal oxide, and more specifically, an indium tin oxide containing overcoat layer, and yet more specifically, to an electrophotographic or electrostatographic imaging member that includes an overcoat formulation that provides excellent mechanical properties such as wear resistance, scratch resistance and low surface energy and processes for the preparation of this layer.

The photoconductors illustrated herein, in embodiments, possess in a number of instances excellent $V_r$ (residual potential), and allow the substantial prevention of $V_r$ cycle up as compared, for example, to similar indium tin oxide free photoconductors. In addition, the photoconductors illustrated herein possess acceptable relative humidity deletion resistance. Yet more specifically, the photoconductors disclosed herein possess in embodiments, consistent $V_r$ (residual potential) that is substantially flat or no change over a number of imaging cycles as illustrated by the generation of known PIDCs (Photo-induced Discharge Curve); minimum cycle up in residual potential; and the like.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the photoconductors of this disclosure can in embodiments be selected for high resolution color xerographic applications, particularly high speed color copying, and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components and processes of the above recited patents may be selected for the present disclosure in embodiments thereof.

EMBODIMENTS

Aspects of the present disclosure relate to a photoconductor comprising an optional supporting substrate, a photogenerating layer, a charge transport layer, and an overcoat layer in contact with and contiguous to the charge transport layer, and which overcoat layer is comprised of an indium tin oxide, an acrylated polyol, a crosslinking component, and a charge transport component; a rigid photoconductive member comprised in sequence of a substrate, a photogenerating layer, and at least one charge transport layer comprised of at least one charge transport component, and wherein the photogenerating layer is comprised of at least one photogenerating pigment, and an overcoat layer in contact with and contiguous to the charge transport layer, and which overcoat layer is comprised of an indium tin oxide, an acrylate polyol, a crosslinking component, a charge transport compound, and a catalyst; and a photoconductor comprising a supporting substrate, a photogenerating layer, a hole transport layer, and wherein the photogenerating layer is comprised of at least one photogenerating pigment, and wherein the photogenerating layer and the hole transport layer include a resin binder; the photogenerating layer is situated between the substrate and the hole transport layer; and a layer in contact with and contiguous to the hole transport layer, and which layer is comprised of a crosslinked polymeric network of an indium tin oxide, an acrylated polyol, a crosslinking component, and a charge transport component, and wherein the acrylated polyol is represented by $$[R_s—CH_2]_t—[—CH_2—R_a—CH_2]_p—[—CO—R_b—CO—]_n—[—CH_2—R_c—CH_2]_p—[—CO—R_d—CO—]_q$$

where $R_s$, represents $CH_2CR_1CO_2$—; wherein t represents the mole fraction acrylic groups on available sites; where $[R_s—CH_2]_t$ can be located in linear or branched portions of $R_a$, $R_b$, $R_c$, and $R_d$; where $R_a$ and $R_c$ independently represent at least one of a linear alkyl group, a linear alkoxy group, a branched alkyl group, and a branched alkoxy group, wherein each alkyl and alkoxy group contain from about 1 to about 20 carbon atoms; $R_b$ and $R_d$ independently represent at least one of an alkyl and alkoxy wherein said alkyl and said alkoxy each contain from about 1 to about 20 carbon atoms; and m, n, p, and q represent mole fractions, such that n+m+p+q=1.

The overcoat layer, which in embodiments is crosslinked, can be generated in the presence of a catalyst by the reaction of a polyol, a crosslinking component, and a charge transport component to form a polymer network; and more specifically, the overcoat layer can be formed by the reaction of an acrylate polyol, a crosslinking agent, and a charge transport compound in the presence of a catalyst resulting in a polymeric network primarily containing the acrylate polyol, the crosslinking agent, and the charge transport compound, and where an indium tin oxide is added to the overcoat layer solution prior to its deposition on the charge transport layer; a photoconductor wherein the acrylated polyol is represented by $$[R_s—CH_2]_t—[—CH_2—R_a—CH_2]_p—[—CO—R_b—CO—]_n—[—CH_2—R_c—CH_2]_p—[—CO—R_d—CO—]_q$$

where $R_s$ represents $CH_2CR_1CO_2$—; where t is, for example, equal to about 0 to 1, and represents the mole fraction acrylic groups on available sites; where $[R_s—CH_2]_t$ can be located in linear or branched portions of $R_a$, $R_b$, $R_c$, and $R_d$; where $R_a$ and $R_c$ independently represent at least one of a linear alkyl group, a linear alkoxy group, a branched alkyl group, and a branched alkoxy group, wherein each alkyl and alkoxy group contain, for example, from about 1 to about 20 carbon atoms; $R_b$ and $R_d$ independently represent at least one of an alkyl and alkoxy wherein the alkyl and the alkoxy each contain from about 1 to about 20 carbon atoms; and m, n, p, and q represent mole fractions of from 0 to 1, such that n+m+p+q=1, and wherein the overcoat layer primarily contains indium tin oxide, an acrylate polyol, a crosslinking agent, and a charge transport compound; a photoconductor wherein the overcoat charge transport component is

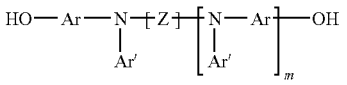

wherein m is zero or 1; Z is selected from the group consisting of at least one of

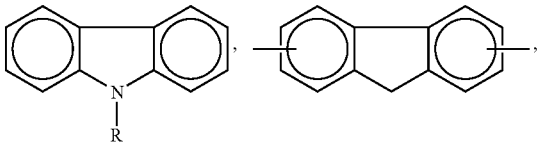

-continued

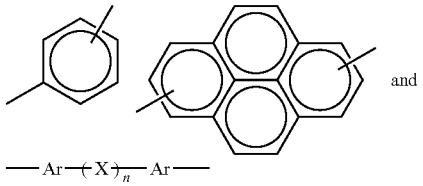

wherein n is 0 or 1; Ar is selected from the group consisting of at least one of

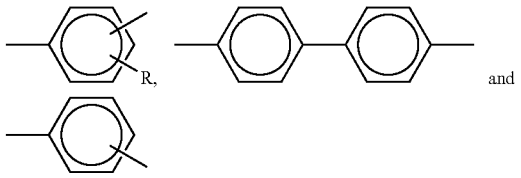

wherein R is selected from the group consisting of at least one of —$CH_3$, —$C_2H_5$, —$C_3H_7$, and $C_4H_9$, and Ar' is selected from the group consisting of at least one of

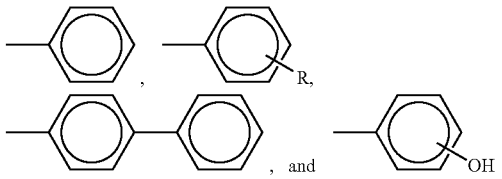

and X is selected from the group consisting of at least one of

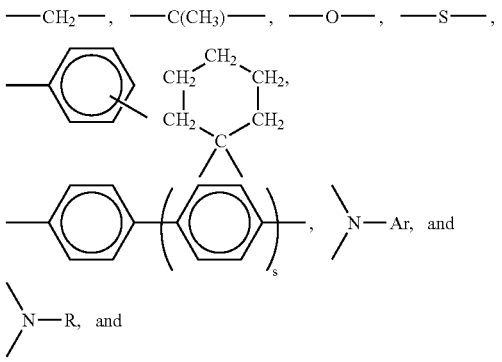

wherein S is zero, 1, or 2; a photoconductor comprising a substrate, a photogenerating layer, at least one charge transport layer, for example, wherein at least one is two, and a crosslinked overcoat layer in contact with and contiguous to the charge transport layer, and which overcoat layer is comprised of indium tin oxide, a charge transport compound, a polymer, and a crosslinking component; a photoconductor comprised in sequence of a supporting substrate, a photogenerating layer comprised of at least one photogenerating pigment, thereover a charge transport layer comprised of at least one charge transport component, and a layer in contact with and contiguous to the top charge transport layer, and which layer is comprised of indium tin oxide, and a crosslinked polymer formed by the reaction of an acrylate polyol, a crosslinking agent, and a charge transport compound in the presence of a catalyst resulting in a polymeric network primarily containing the indium tin oxide, an acrylate polyol, a crosslinking agent, and a charge transport compound, and where the acrylated polyol is represented by $$[R_s—CH_2]_t—[—CH_2—R_a—CH_2]_p—[—CO—R_b—CO—]_n—[—CH_2—R_c—CH_2]_p—[—CO—R_d—CO—]_q$$

where $R_s$, represents $CH_2CR_1CO_2$—; where t is equal to about 0 to 1 and represents the mole fraction acrylic groups on available sites; where $[R_s—CH_2]_t$ can be located in linear or branched portions of $R_a$, $R_b$, $R_c$, and $R_d$; where $R_a$ and $R_c$ independently represent at least one of a linear alkyl group, a linear alkoxy group, a branched alkyl group, and a branched alkoxy group wherein each alkyl and alkoxy group contain from about 1 to about 20 carbon atoms; $R_b$ and $R_d$ independently represent at least one of an alkyl and alkoxy wherein the alkyl and the alkoxy each contain from about 1 to about 20 carbon atoms; and m, n, p, and q represent mole fractions of from 0 to 1, such that n+m+p+q is equal to about 1; a photoconductor where in contact with the charge transport layer there is deposited a top overcoat crosslinked layer comprised of a mixture of a polyol, such as an acrylated polyol, a charge transport compound, a crosslinking agent, and indium tin oxide, and which overcoat layer is formed in the presence of an acid catalyst; a photoconductor wherein each of the charge transport layers, especially a first and second layer, or a single charge transport layer and the charge transport compound in the overcoat layer comprises

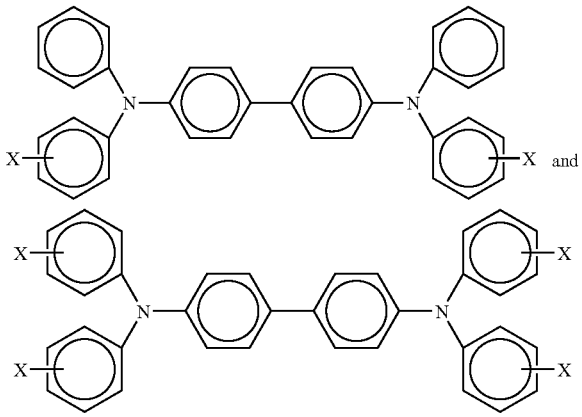

wherein X is selected from the group consisting of alkyl, alkoxy, and halogen, such as methyl and chloride; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each or at least one of the charge transport layers, especially a first and second charge transport layer, or a single charge transport layer, and the charge transport compound in the charge transport layer comprises

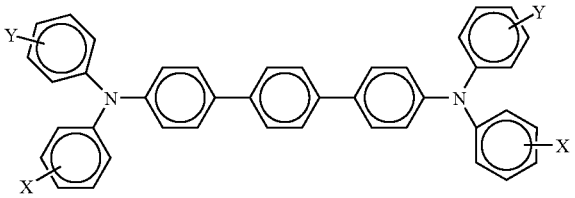

wherein X and Y are independently alkyl, alkoxy, aryl, a halogen, or mixtures thereof; an imaging member wherein, for example, alkyl and alkoxy contains from about 1 to about 15 carbon atoms; alkyl contains from about 1 to about 5 carbon atoms; and wherein the photogenerating pigment is dispersed in from about 10 weight percent to about 80 weight percent of a polymer binder; a member wherein the thickness of the photogenerating layer is from about 0.1 to about 11 microns; a member wherein the photogenerating and charge transport layer components are contained in a polymer binder; a member wherein the binder is present in an amount of from about 30 to about 90 percent by weight, and wherein the total of the layer components is about 100 percent; wherein the photogenerating resinous binder is selected from the group consisting of copolymers of vinyl chloride and vinyl acetate, copolymers of vinyl acid and vinyl acetate, copolymers of vinyl acid, vinyl alcohol and vinyl acetate, polyvinyl chloride-co-vinyl acetate-co-maleic acid, polyesters, polyvinyl butyrals, polycarbonates, polystyrene-b-polyvinyl pyridine, and polyvinyl formals; an imaging member wherein the photogenerating component is a hydroxygallium phthalocyanine, a titanyl phthalocyanine, a chlorogallium phthalocyanine or a perylene, and the charge transport layer contains a hole transport molecule of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, or N,N'-diphenyl-N,N'-bis(3-chlorophenyl)-[p-terphenyl]-4,4"-diamine molecules, and wherein the hole transport resinous binder is selected from the group consisting of polycarbonates, polyarylates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; an imaging member further containing an adhesive layer and a hole blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer, and a top overcoat layer in contact with the hole transport layer, or in embodiments in contact with the photogenerating layer, and in embodiments wherein a plurality of charge transport layers are selected, such as, for example, from 2 to about 10, and more specifically, 2 may be selected; and a photoconductive imaging member comprised of an optional supporting substrate, a photogenerating layer, and a first, second, and third charge transport layer.

PHOTOCONDUCTOR LAYER EXAMPLES

There can be selected for the photoconductors disclosed herein a number of known layers, such as substrates, photogenerating layers, charge transport layers (CTL), hole blocking layers, adhesive layers, protective overcoat layers, and the like. Examples, thicknesses, specific components of many of these layers include the following.

The thickness of the photoconductor substrate layer depends on various factors, including economical considerations, desired electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns, ("about" throughout includes all values in between the values recited) or of a minimum thickness. In embodiments, the thickness of this layer is from about 75 microns to about 300 microns, or from about 100 to about 150 microns. In embodiments, the photoconductor can be free of a substrate, for example, the layer usually in contact with the substrate can be increased in thickness. For a photoconductor drum, the substrate or supporting medium may be of substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

Also, the photoconductor may in embodiments include a blocking layer, an adhesive layer, a top overcoating protective layer, and an anti curl backing layer.

The photoconductor substrate may be opaque, substantially opaque, or substantially transparent, and may comprise any suitable material that, for example, permits the photoconductor layers to be supported. Accordingly, the substrate may comprise a number of know layers, and more specifically, the substrate can be comprised of an electrically nonconductive or conductive material such as an inorganic or an organic composition. As electrically nonconducting materials, there may be selected various resins known for this purpose including polyesters, polycarbonates, polyamides, polyurethanes, and the like, which are flexible as thin webs. An electrically conducting substrate may comprise any suitable metal of, for example, aluminum, nickel, steel, copper, and the like, or a polymeric material, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like.

In embodiments where the substrate layer is to be rendered conductive, the surface thereof may be rendered electrically conductive by an electrically conductive coating. The conductive coating may vary in thickness depending upon the optical transparency, degree of flexibility desired, and economic factors, and in embodiments this layer can be of a thickness of from about 0.05 micron to about 5 microns.

Illustrative examples of substrates are as illustrated herein, and more specifically, supporting substrate layers selected for the photoconductors of the present disclosure, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, and more specifically, alkylhydroxyl gallium phthalocyanines, hydroxygallium phthalocyanines, chlorogallium phthalocyanines, perylenes, especially bis(benzimidazo)perylene, titanyl phthalocyanines, and the like, and yet more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume.

The photogenerating composition or pigment is present in the resinous binder composition in various amounts, inclusive of 100 percent by weight based on the weight of the photogenerating components that are present. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon, and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

In embodiments, examples of polymeric binder materials that can be selected as the matrix for the photogenerating layer components are known and include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly (amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer, or interfacial layer and the photogenerating layer. Usually, the photogenerating layer is applied onto the blocking layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 10 microns to about 45 microns. Examples of charge transport components are aryl amines of the following formulas/structures

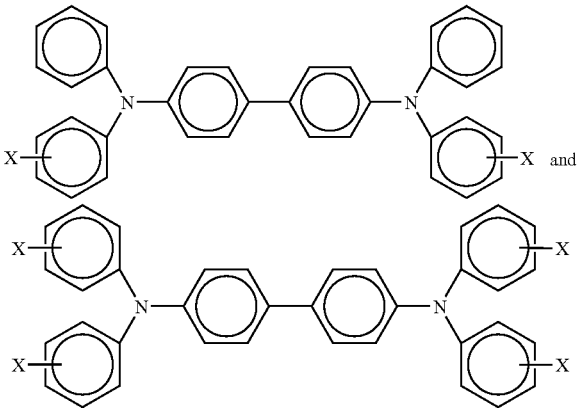

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

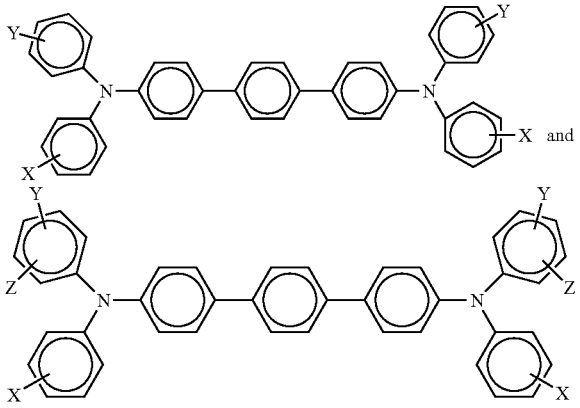

wherein X, Y and Z are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. When appropriate, the charge transport material in the charge transport layer may comprise a polymeric charge transport material or a combination of a small molecule charge transport material and a polymeric charge transport material.

Examples of components or materials optionally incorporated into the charge transport layers or at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional overcoating may be applied over the charge transport layer to provide abrasion protection.

The photoconductors disclosed herein include a protective overcoat layer (POC) usually in contact with and contiguous to the charge transport layer. This POC layer is comprised of indium tin oxide in an amount of, for example, from 0.1 to about 30, from 1 to about 20, from 5 to about 15 weight percent, and components that include an acrylated polyol, at least one transport compound, and at least one crosslinking agent. The overcoat layer composition can comprise an acrylated polyol with a hydroxyl number of from about 10 to about 20,000; a charge transport compound; an acid catalyst; and a crosslinking agent wherein the overcoat layer, which is crosslinked, contains a polyol, such as an acrylated polyol, a crosslinking agent residue and a catalyst residue, all reacted into a polymeric network. While the percentage of crosslinking can be difficult to determine and not be desired to be limited by theory, the overcoat layer is crosslinked to a suitable value, such as for example, from about 50 to about 100 percent. Excellent photoconductor electrical response can also be achieved when the prepolymer hydroxyl groups, and the hydroxyl groups of the dihydroxy aryl amine (DHTPD) are stoichiometrically less than the available methoxy alkyl on the crosslinking, such as CYMEL® moieties.

The prepolymer contains a reactive group selected from the group consisting of hydroxyl and carboxylic acid. The term "prepolymer" means monomer or low molecular weight polymer that contains reactive groups and forms a crosslinked polymer network when reacted with a crosslinking agent. Low molecular weight polymers are the result of reacting monomers to form very short polymers containing from about 5 to about 100 units. These products exhibit poor mechanical properties. Increasing chain length to from about 500 to about 1,000 units is necessary to discover mature polymer properties. Crosslinked systems are different in that chain length cannot be determined due to insolubility of the system. Polymer chains are two dimensions, while crosslinking creates three-dimensional networks. In embodiments, the prepolymer is a monomer or low molecular weight polymer containing hydroxyl or carboxylic acid.

The photoconductor overcoat layer can be applied by a number of different processes inclusive of dispersing the indium tin oxide and the overcoat composition in a solvent system, and applying the resulting overcoat dispersion onto the receiving surface, for example, the top charge transport layer of the photoreceptor to a thickness of, for example, from about 0.5 micron to about 15, or from 2 to about 8 microns.

According to various embodiments, the crosslinkable polymer present in the overcoat layer can comprise a mixture of polyol, such as acrylated polyol film forming resins, and where, for example, the crosslinkable polymer can be electrically insulating, semiconductive or conductive, and can be charge transporting or free of charge transporting characteristics. Examples of polyols include a highly branched polyol where highly branched refers, for example, to a prepolymer synthesized using a sufficient amount of trifunctional alcohols, such as triols or a polyfunctional polyol with a high hydroxyl number to form a polymer comprising a number of branches off of the main polymer chain. The polyol can possess a hydroxyl number of, for example, from about 10 to about 10,000 and can include ether groups, or can be free of ether groups. Suitable acrylated polyols can be, for example, generated from the reaction products of propylene oxide modified with ethylene oxide, glycols, triglycerol, and the like, and wherein the acrylated polyols in embodiments can be represented by $$[R_s—CH_2]_t—[—CH_2—R_a—CH_2]_p—[—CO—R_b—CO—]_n—[—CH_2—R_c—CH_2]_p—[—CO—R_d—CO—]_q$$

where $R_s$, represents $CH_2CR_1CO_2$—; t equals 0 to 1 and represents the mole fraction acrylic groups on available sites; where $[R_s—CH_2]_t$ can be located in linear or branched portions of $R_a$, $R_b$, $R_c$, and $R_d$; $R_1$ is alkyl with, for example, from 1 to about 25 carbon atoms, and more specifically, from 1 to about 12 carbon atoms, such as methyl, ethyl, propyl, butyl, hexyl, heptyl, and the like; $R_a$ and $R_c$ independently represent linear alkyl groups, alkoxy groups, branched alkyl or branched alkoxy groups with alkyl and alkoxy groups possessing, for example, from 1 to about 20 carbon atoms; $R_b$ and $R_d$ independently represent alkyl or alkoxy groups having, for example, from 1 to about 20 carbon atoms; and m, n, p, and q represent mole fractions of from 0 to 1, such that n+m+p+q=1. Examples of commercial acrylated polyols are JONCRYL™ polymers, available from Johnson Polymers Inc., PARALOID™ polymers, available from Rohm and Haas, and POLYCHEM™ polymers, available from OPC polymers.

The overcoat layer includes in embodiments a crosslinking agent and catalyst where the crosslinking agent can be, for example, a melamine crosslinking agent or accelerator. Incorporation of a crosslinking agent can provide reaction sites to interact with the acrylated polyol to provide a branched, crosslinked structure. When so incorporated, any suitable crosslinking agent or accelerator can be used, including, for example, trioxane, melamine compounds, and mixtures thereof. When melamine compounds are selected, they can be functionalized, examples of which are melamine formaldehyde, methoxymethylated melamine compounds, such as glycouril-formaldehyde and benzoguanamine-formaldehyde, and the like. In some embodiments, the crosslinking agent can include a methylated, butylated melamine-formaldehyde. A nonlimiting example of a suitable methoxymethylated melamine compound can be CYMEL® 303 (available from Cytec Industries), which is a methoxymethylated melamine compound with the formula $(CH_3OCH_2)_6N_3C_3N_3$ and the following structure

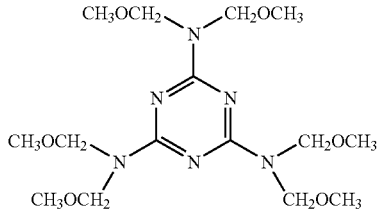

Crosslinking can be accomplished by heating the overcoat components in the presence of a catalyst. Non-limiting examples of catalysts include oxalic acid, maleic acid, carbolic acid, ascorbic acid, malonic acid, succinic acid, tartaric acid, citric acid, p-toluenesulfonic acid (pTSA), methanesulfonic acid, dodecylbenzene sulfonic acid (DDBSA), dinonylnaphthalene disulfonic acid (DNNDSA), dinonylnaphthalene monosulfonic acid (DNNSA), and the like, and mixtures thereof.

A blocking agent can also be included in the overcoat layer, which agent can "tie up" or substantially block the acid catalyst effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine, triethylamine, and the like as well as commercial acid solutions containing blocking agents such as CYCAT® 4045, available from Cytec Industries Inc.

The temperature used for crosslinking varies with the specific catalyst, the catalyst amount, heating time utilized, and the degree of crosslinking desired. Generally, the degree of crosslinking selected depends upon the desired flexibility of the final photoreceptor. For example, complete crosslinking, that is 100 percent, may be used for rigid drum or plate photoreceptors. However, partial crosslinking, for example from about 20 percent to about 80 percent, is usually selected for flexible photoreceptors having, for example, web or belt configurations. The amount of catalyst to achieve a desired degree of crosslinking will vary depending upon the specific coating solution materials, such as polyol/acrylated polyol, catalyst, temperature, and time used for the reaction. Specifically, the polyester polyol/acrylated polyol is crosslinked at a temperature between about 100° C. and about 150° C. A typical crosslinking temperature used for polyols/acrylated polyols with p-toluenesulfonic acid as a catalyst is less than about 140° C., for example 135° C. for about 1 minute to about 40 minutes. A typical concentration of acid catalyst is from about 0.01 to about 5 weight percent based on the weight of polyol/acrylated polyol. After crosslinking, the overcoat layer should be substantially insoluble in the solvent in which it was soluble prior to crosslinking, thus permitting no overcoat material to be removed when rubbed with a cloth soaked in the solvent. Crosslinking results in the development of a three-dimensional network which restrains the transport molecule in the crosslinked polymer network.

The overcoat layer can also include a charge transport material to, for example, improve the charge transport mobility of the overcoat layer. According to various embodiments, the charge transport material can be selected from the group consisting of at least one of (i) a phenolic substituted aromatic amine, (ii) a primary alcohol substituted aromatic amine, and (iii) mixtures thereof. In embodiments, the charge transport material can be a terphenyl of, for example, an alcohol soluble dihydroxy terphenyl diamine, an alcohol-soluble dihydroxy TPD, and the like. An example of a terphenyl charge transporting molecule can be represented by the following formula

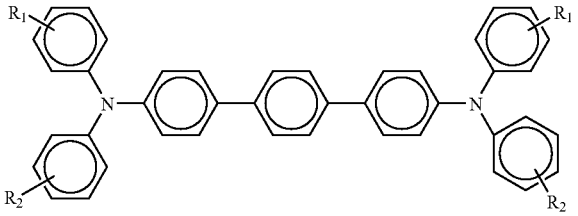

where each $R_1$ is —OH; and $R_2$ is alkyl (—$C_nH_{2n+1}$) where, for example, n is from 1 to about 10, from 1 to about 5, or from about 1 to about 6; and aralkyl and aryl groups with, for example, from about 6 to about 30, or about 6 to about 20 carbon atoms. Suitable examples of aralkyl groups include, for example, —$C_nH_{2n}$-phenyl groups where n is, for example, from about 1 to about 5 or from about 1 to about 10. Suitable examples of aryl groups include, for example, phenyl, naphthyl, biphenyl, and the like. In one embodiment, each $R_1$ is —OH to provide a dihydroxy terphenyl diamine hole transport molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each $R_2$ is independently an alkyl, aralkyl, or aryl group as defined above. In various embodiments, the charge transport material is soluble in the selected solvent used in forming the overcoat layer.

Additionally, there may be included in the overcoat layer low surface energy components, such as hydroxyl terminated fluorinated additives, hydroxyl silicone modified polyacrylates, and mixtures thereof. Examples of the low surface energy components, present in various effective amounts, such as from about 0.1 to about 25, from about 0.5 to about 15, from about 1 to about 10 weight percent, are hydroxyl derivatives of perfluoropolyoxyalkanes such as FLUOROLINK® D (M.W. about 1,000 and fluorine content about 62 percent), FLUOROLINK® D10-H (M.W. about 700 and fluorine content about 61 percent), and FLUOROLINK® D10 (M.W. about 500 and fluorine content about 60 percent) (functional group —$CH_2OH$); FLUOROLINK® E (M.W. about 1,000 and fluorine content about 58 percent) and FLUOROLINK® E10 (M.W. about 500 and fluorine content about 56 percent) (functional group —$CH_2(OCH_2CH_2)_nOH$); FLUOROLINK® T (M.W. about 550 and fluorine content about 58 percent) and FLUOROLINK® T10 (M.W. about 330 and fluorine content about 55 percent) (functional group —$CH_2OCH_2CH(OH)CH_2OH$); and hydroxyl derivatives of perfluoroalkanes ($R_fCH_2CH_2OH$, wherein $R_f$=$F(CF_2CF_2)_n$) such as ZONYL® BA (M.W. about 460 and fluorine content about 71 percent), ZONYL® BA-L (M.W. about 440 and fluorine content about 70 percent), ZONYL® BA-LD (M.W. about 420 and fluorine content about 70 percent), and ZONYL® BA-N (M.W. about 530 and fluorine content about 71 percent); carboxylic acid derivatives of fluoropolyethers such as FLUOROLINK® C (M.W. about 1,000 and fluorine content about 61 percent), carboxylic ester derivatives of fluoropolyethers such as FLUOROLINK® L (M.W. about 1,000 and fluorine content about 60 percent), FLUOROLINK® L10 (M.W. about 500 and fluorine content about 58 percent), carboxylic ester derivatives of perfluoroalkanes ($R_fCH_2CH_2O(C{=}O)R$, wherein $R_f$=$F(CF_2CF_2)_n$ and R is alkyl) such as ZONYL® TA-N (fluoroalkyl acrylate, R=$CH_2{=}CH$—, M.W. about 570 and fluorine content about 64 percent), ZONYL® TM (fluoroalkyl methacrylate, R=$CH_2{=}C(CH_3)$—, M.W. about 530 and fluorine content about 60 percent), ZONYL® FTS (fluoroalkyl stearate, R=$C_{17}H_{35}$—, M.W. about 700 and fluorine content about 47 percent), ZONYL® TBC (fluoroalkyl citrate, M.W. about 1,560 and fluorine content about 63 percent), sulfonic acid derivatives of perfluoroalkanes ($R_fCH_2CH_2SO_3H$, wherein $R_f$=$F(CF_2CF_2)_n$) such as ZONY®L TBS (M.W. about 530 and fluorine content about 62 percent); ethoxysilane derivatives of fluoropolyethers such as FLUOROLINK® S10 (M.W. about 1,750 to 1,950); phosphate derivatives of fluoropolyethers such as FLUOROLINK® F10 (M.W. about 2,400 to 3,100); hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, Inc., ZONYL® is a trademark of E.I. DuPont, and BYK-SILCLEAN® is a trademark of BYK Silclean.

Any suitable solvent, such as a secondary or tertiary alcohol solvent, can be employed for the deposition of the film forming overcoat layer. Typical alcohol solvents include, but are not limited to, for example, tert-butanol, sec-butanol, n-butanol, 2-propanol, 1-methoxy-2-propanol, and the like, and mixtures thereof. Other suitable co-solvents that can be selected for the forming of the overcoat layer such as, for example, tetrahydrofuran, monochlorobenzene, methylene chloride, toluene, xylene and mixtures thereof. These cosolvents can be used as diluents for the above alcohol solvents, or they can be omitted. However, in some embodiments, it may be of value to minimize or avoid the use of higher boiling alcohol solvents since they should be removed as they may interfere with efficient crosslinking.

In embodiments, the components, including the crosslinkable polymer, charge transport material, crosslinking agent, acid catalyst, and blocking agent, utilized for the overcoat solution should be soluble or substantially soluble in the solvents or solvents employed for the overcoat layer.

The thickness of the overcoat layer, which can depend upon the abrasiveness of, for example, the bias charging roll, cleaning, for example, blade or web cleaning, development, transfer, for example, with a bias transfer roll, is, for example, from about 1 or about 2 microns, from about 10 to about 20 microns, and the like. In various embodiments, the thickness of the overcoat layer can be from about 1 micrometer to about 10 micrometers. Typical application techniques for applying the overcoat layer over the photoconductive layer can include spraying, dip coating, roll coating, wire wound rod coating, extrusion coating, flow coating, and the like. Drying of the deposited overcoat layer can be effected by any suitable conventional technique such as oven drying, infrared radiation drying, air drying, and the like. The dried overcoat layer of this disclosure should transport charges during imaging.

In the dried overcoat layer, the composition can include from about 40 to about 90 percent by weight of film forming crosslinkable polymer, and from about 60 to about 10 percent by weight of the charge transport material. For example, in embodiments, the charge transport material can be incorporated into the overcoat layer in an amount of from about 20 to about 50 percent by weight. The overcoat layer can also include other materials, such as conductive fillers, abrasion resistant fillers, low surface energy agents and the like, in any suitable and known amounts.

Although not desired to be limited by theory, the crosslinking agent can be located in the central region with the polymers like the acrylated polyol, polyalkylene glycol, and also charge transport component being associated with the crosslinking agent, and extending in embodiments from the central region.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers (components) for each of the layers specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. Similarly, the thickness of each of the layers, the examples of components in each of the layers, the amount ranges of each of the components disclosed and claimed are not exhaustive, and it is intended that the present disclosure and claims encompass other suitable parameters not disclosed or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

Comparative Example 1

A three component hole blocking or undercoat layer was prepared as follows. Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The coating solution was coated via a dip coater, and the layer was pre-heated at 59° C. for 13 minutes, humidified at 58° C. (dew point=54° C.) for 17 minutes, and dried at 135° C. for 8 minutes. The thickness of the undercoat layer was approximately 1.3 microns.

A photogenerating layer at a thickness of about 0.2 micron comprising hydroxygallium phthalocyanine Type V was deposited on the above hole blocking layer or undercoat layer at a thickness of about 1.3 microns. The photogenerating layer coating dispersion was prepared as follows. 3 Grams of the hydroxygallium Type V pigment were mixed with 2 grams of a polymeric binder of a carboxyl-modified vinyl copolymer, VMCH, available from Dow Chemical Company, and 45 grams of n-butyl acetate. The resulting mixture was milled in an Attritor mill with about 200 grams of 1 millimeter Hi-Bea borosilicate glass beads for about 3 hours. The dispersion obtained was filtered through a 20 micron Nylon cloth filter, and the solid content of the dispersion was diluted to about 6 weight percent.

Subsequently, (A) a 24 micron thick, or (B) a 18 micron thick charge transport layer was coated on top of the photogenerating layer from a solution prepared from N,N'-diphenyl-N,N-bis(3-methylphenyl)-1,1'-biphenyl-4,4'-diamine (5 grams), a film forming polymer binder PCZ 400 [poly(4,4'-dihydroxy-diphenyl-1-1-cyclohexane, $M_w$=40,000)] available from Mitsubishi Gas Chemical Company, Ltd. (7.5 grams) in a solvent mixture of 30 grams of tetrahydrofuran (THF) and 10 grams of monochlorobenzene (MCB) via simple mixing. The charge transport layer was dried at about 135° C. for about 40 minutes.

Comparative Example 2

A photoconductor was prepared by repeating the above process of Comparative Example 1 (B) except that an overcoat layer was applied to the charge transport layer. The overcoat layer solution was formed by adding 0.5 gram of JONCRYL™ 587 (an acrylated polyol obtained from Johnson Polymers), 0.7 gram of CYMEL® 303 (a methylated, butylated melamine-formaldehyde crosslinking agent obtained from Cytec Industries Inc.), 0.6 gram of N,N'-diphenyl-N,N'-bis(3-hydroxyphenyl)-[1,1'-biphenyl]-4,4'-diamine (DHTBD), 0.072 gram of BYK-SILCLEAN® 3700 (a hydroxylated silicone modified polyacrylate obtained from BYK-Chemie USA), and 0.09 gram of NACURE® XP357 (a blocked acid catalyst obtained from King Industries) in 7.2 grams of DOWANOL® PM (1-methoxy-2-propanol obtained from the Dow Chemical Company).

The photoconductor, and more specifically the charge transport layer of Comparative Example 1 (B) with an 18 micron charge transport layer was then overcoated with the above prepared overcoat solution using a ring coater. The resultant overcoat layer was dried in a forced air oven for 40 minutes at 140° C. to yield a highly crosslinked, 6 micron thick overcoat layer, and which overcoat layer was substantially insoluble in methanol or ethanol. The total thickness of the charge transport layer and the overcoat layer was 24 microns, which was the same as the charge transport layer thickness of Comparative Example 1 (A).

Example I

A photoconductor was prepared by repeating the process of Comparative Example 2 except that 0.18 gram of Nanotek® indium tin oxide (90 weight percent of indium oxide and 10 weight percent of tin oxide, average particle size about 20 nanometer, B.E.T. surface area about 40 $m^2/g$, faceted morphology, available from Nanophase Technologies Corporation, Romeoville, Ill.) was added into the overcoat solution. The resulting overcoat mixture was ball milled with 0.4 to 0.6 millimeter $ZrO_2$ beads at 200 rpm for 18 hours, and then filtered through a 20 micron Nylon cloth.

The resulting photoconductor containing overcoat layer coated from the above overcoat dispersion was dried in a forced air oven for 40 minutes at 140° C. to yield a highly crosslinked, 6 micron thick overcoat layer, and which overcoat layer was substantially insoluble in methanol or ethanol. The total thickness of the charge transport layer and the overcoat layer was 24 microns, which was the same as the charge transport layer thickness of Comparative Example 1 (A).

Electrical Property Testing

The above prepared photoconductor devices of Comparative Examples 1 (A) and 2, and Example I were tested in a scanner set to obtain photoinduced discharge cycles, sequenced at one charge-erase cycle, followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of −700 volts with the exposure light intensity incrementally increased by means of a data acquisition system where the current to the light emitting diode was controlled to obtain different exposure levels. The exposure light source was a 780 nanometer light emitting diode. The known xerographic simulation process was completed in an environmentally controlled light tight chamber at ambient conditions (40 percent relative humidity and 22° C.). The results are summarized in Table 1.

TABLE 1

| | V (2.8 ergs/$cm^2$) (V) | V (6.0 ergs/$cm^2$) (V) |
|---|---|---|
| Comparative Example 1 (A) | 113 | 54 |
| Comparative Example 2 | 210 | 148 |
| Example I | 151 | 90 |

In embodiments, there are disclosed a number of improved characteristics for the photoconductor of Example I as determined by the generation of the known PIDC curve, such as more rapid transport when compared with the similarly overcoated photoconductor of Comparative Example 2. More specifically, V (2.8 ergs/$cm^2$) and V (6.0 ergs/$cm^2$) in Table 1 represent the surface potential of the photoconductor, respectively, when exposure is 3.5 ergs/$cm^2$ and 6 ergs/$cm^2$, and this was used to characterize the PIDC.

It is known that an overcoat layer does not usually transport charge rapidly, thus an extra 6 micron overcoat of Comparative Example 2 elevated both V (2.8 ergs/$cm^2$) and V (6.0 ergs/$cm^2$) by about 100V when compared with the non-overcoated photoconductor of Comparative Example 1 (A), although the total charge transporting thickness was the same (24 microns) for both photoconductors.

The conductive indium tin oxide nanoparticle incorporated into the overcoat layer (Example I) illustrates acceleration of charge transport in the overcoat by the above data that both V (2.8 ergs/$cm^2$) and V (6 ergs/$cm^2$) were reduced by about 60V when compared with the similarly overcoated Comparative Example 2 photoconductor.

Cyclic Stability Testing

The above-prepared photoconductor of Example I was tested for cyclic stability by using an in-house high-speed Hyper Mode Test (HMT) at warm and humid conditions (80 percent relative humidity and 80° F.). The HMT fixture rotated the drum photoconductor at 150 rpm under a Scorotron set to −700 volts then exposed the drum with a LED erase lamp. Two voltage probes were positioned 90 degrees apart to measure $V_{high}$ ($V_H$) and $V_{residual}$ ($V_L$) with nonstop 1 million cycles of charge/discharge/erase cycling. The ozone that was produced during cycling was evacuated out of the chamber by means of an air pump and ozone filter. The HMT cycling results are shown in Table 2.

TABLE 2

| | | HMT Cycles | | | |
|---|---|---|---|---|---|
| | | 100 | 200,000 | 400,000 | 600,000 |
| Example I | $V_H$ (V) | 660 | 651 | 650 | 653 |
| | $V_L$ (V) | 80 | 90 | 95 | 98 |

After a continuous 600 kilocycles, both $V_H$ and $V_L$ for the disclosed photoconductor Example I remained almost unchanged, and possessed excellent and improved cyclic stability.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, a charge transport layer, and an overcoat layer in contact with and contiguous to said charge transport layer, and which overcoat layer is comprised of a crosslinked polymeric network of an indium tin oxide in an amount of from about 0.1 to about 30 weight percent, an acrylated polyol, a crosslinking component, and a charge transport component.

2. A photoconductor in accordance with claim 1 wherein said photogenerating layer is comprised of at least one photogenerating pigment, and wherein said overcoat layer is generated in the presence of a catalyst by the reaction of said polyol, said crosslinking component, and said charge transport component to form a polymer network.

3. A photoconductor in accordance with claim 1 wherein said photogenerating layer is comprised of a photogenerating component, and a polymer binder.

4. A photoconductor in accordance with claim 1 wherein said charge transport layer is comprised of aryl amine molecules, and which aryl amines are of the formula

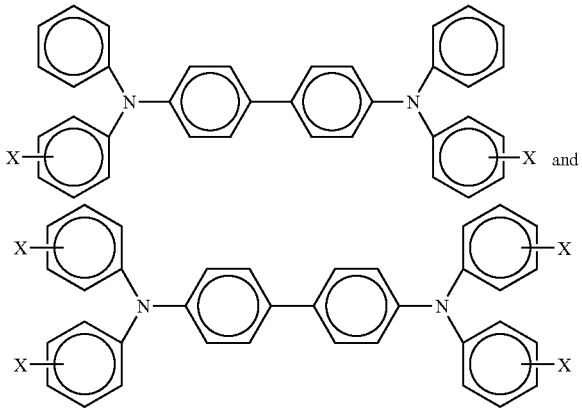

wherein X is selected from the group consisting of alkyl, alkoxy, aryl, and halogen, and mixtures thereof.

5. A photoconductor in accordance with claim 1 wherein said charge transport layer is comprised of

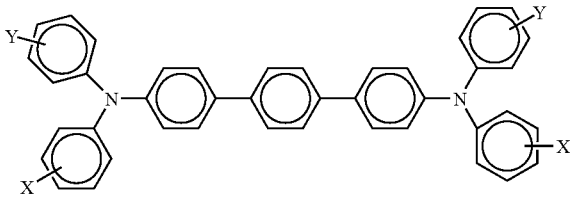

wherein each X and Y is independently selected from the group consisting of at least one of alkyl, alkoxy, aryl, and halogen.

6. A photoconductor in accordance with claim 1 wherein said charge transport layer contains a component selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, and mixtures thereof.

7. A photoconductor in accordance with claim 1 wherein said charge transport layer contains an antioxidant comprised of a hindered phenol or a hindered amine, and said indium tin oxide is present in an amount of from about 1 to about 10 weight percent.

8. A photoconductor in accordance with claim 1 wherein said photogenerating layer includes a photogenerating pigment, and said oxide is present in an amount of from about 1 to about 12 weight percent.

9. A photoconductor in accordance with claim 1 wherein said charge transport layer includes an aryl amine and a polymer binder, and wherein said indium tin oxide is present in an amount of from about 2 to about 8 weight percent.

10. A photoconductor in accordance with claim 1 wherein said charge transport layer is comprised of a top charge transport layer and a bottom charge transport layer, and wherein said bottom layer is situated between said photogenerating layer and said top charge transport layer, and wherein said indium tin oxide is present in an amount of from about 1 to about 10 weight percent.

11. A photoconductor in accordance with claim 10 wherein said top layer is comprised of at least one charge transport component and at least one polymer binder, and said bottom layer is comprised of at least one charge transport component and at least one resin binder; wherein said overcoat layer is generated in the presence of a catalyst by the reaction of said polyol, said crosslinking component, and said charge transport component to form a polymer network containing said indium tin oxide.

12. A photoconductor in accordance with claim 1 wherein said overcoat layer comprises a crosslinkable fluoro additive or a siloxane component in an amount of from about 0.01 to about 5 weight percent, and said crosslinkable component is selected from the group consisting of hydroxyl, carboxylic acid, carboxylic ester, sulfonic acid, silane, phosphate, and mixtures thereof.

13. A photoconductor in accordance with claim 1 wherein said charge transport component is selected from the group consisting of at least one of (i) a phenolic substituted aromatic amine, and (ii) a primary alcohol substituted aromatic amine.

14. A photoconductor in accordance with claim 1 wherein said charge transport component is

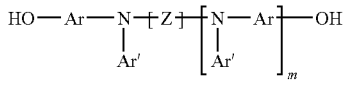

wherein m is zero or 1; Z is selected from the group consisting of at least one of

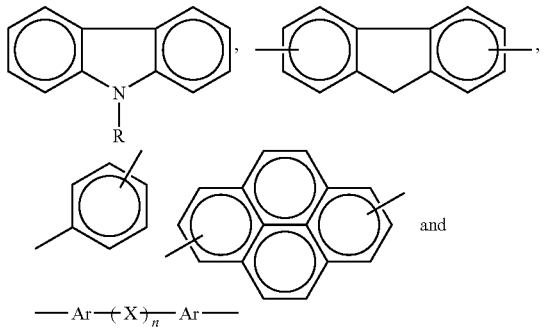

wherein n is 0 or 1; Ar is selected from the group consisting of at least one of

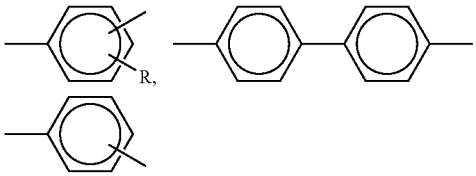

R is selected from the group consisting of at least one of —$CH_3$, —$C_2H_5$, —$C_3H_7$, and $C_4H_9$, and Ar' is selected from the group consisting of at least one of

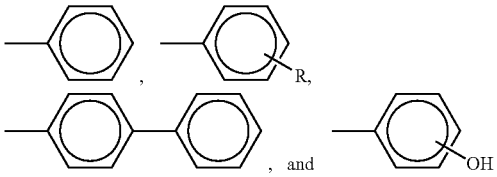

and X is selected from the group consisting of at least one of

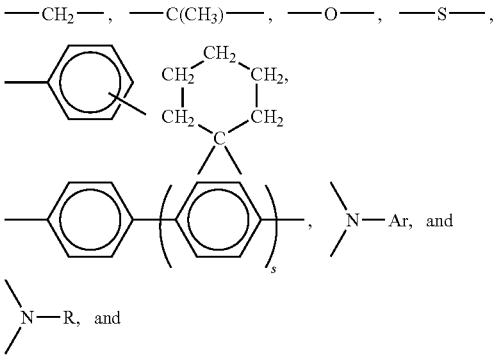

wherein S is zero, 1, or 2.

15. A photoconductor in accordance with claim 1 wherein said charge transport component is a terphenyl diamine of the following formula

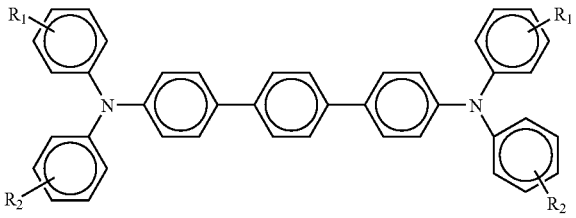

wherein $R_1$ and $R_2$ are independently selected from the group consisting of hydrogen, hydroxyl, alkyl with from 1 to about 12 carbon atoms, arylalkyl with from about 6 to about 36 carbon atoms, and aryl with from about 6 to about 36 carbon atoms groups, wherein at least one of $R_1$ and $R_2$ is not hydrogen.

16. A photoconductor in accordance with claim 1 wherein said crosslinking component is a melamine formaldehyde resin represented by

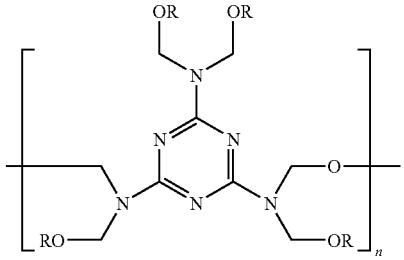

wherein R is selected from the group consisting of hydrogen, methyl, ethyl, propyl, butyl, and mixtures thereof; and n represents the number of repeating units of from about 1 to about 100; and said acrylated polyol is represented by $$[R_s—CH_2]_t—[—CH_2—R_a—CH_2]_p—[—CO—R_b—CO—]_n—[—CH_2—R_c—CH_2]_p—[—CO—R_d—CO—]_q$$

wherein $R_s$, represents $CH_2CR_1CO_2$—; wherein t is equal to 0 or 1 and represents the mole fraction acrylic groups on available sites; wherein $[R_s—CH_2]_t$ can be located in linear or branched portions of $R_a$, $R_b$, $R_c$, and $R_d$; where $R_a$ and $R_c$ independently represent at least one of an alkyl group, and an alkoxy group; $R_b$ and $R_d$ independently represent at least one of alkyl and alkoxy; and m, n, p, and q represent mole fractions, such that n+m+p+q is equal to about 1, and wherein said overcoat primarily contains said indium tin oxide, acrylated polyol, said crosslinking component, and said charge transport component.

17. A photoconductor in accordance with claim 1 wherein said crosslinking component is a melamine compound represented by

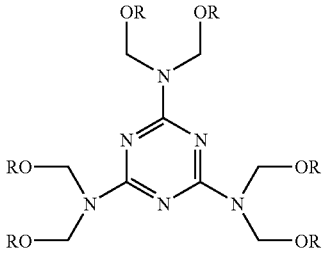

wherein R is selected from the group consisting of at least one of hydrogen, methyl, ethyl, propyl, isopropyl, isobutyl, and n-butyl.

18. A photoconductor in accordance with claim 1 wherein said photogenerating layer is comprised of at least one of a metal phthalocyanine, metal free phthalocyanine, a titanyl phthalocyanine, a halogallium phthalocyanine, a hydroxygallium phthalocyanine, a perylene, or mixtures thereof.

19. A photoconductor in accordance with claim 1 wherein said indium tin oxide contains from about 1 to 99 percent of indium oxide, and from about 1 to about 99 of tin oxide.

20. A photoconductor in accordance with claim 1 wherein said indium tin oxide contains from about 50 to 95 percent of indium oxide, and from about 5 to about 50 of tin oxide.

21. A rigid photoconductive member comprised in sequence of a substrate, a photogenerating layer, and at least one charge transport layer comprised of at least one charge transport component, and wherein said photogenerating layer is comprised of at least one photogenerating pigment, and an overcoat layer in contact with and contiguous to said charge transport layer, and which overcoat layer is comprised of an indium tin oxide in an amount of from about 0.1 to about 30 weight percent, an acrylate polyol, a crosslinking component, a charge transport compound, and a catalyst.

22. A photoconductor in accordance with claim 21 wherein said indium tin oxide contains from about 70 to about 90 percent indium oxide, and from about 10 to about 30 tin oxide, and wherein the catalyst is an acid.

23. A photoconductor in accordance with claim 21 further including a hole blocking layer and an adhesive layer.

24. A photoconductor comprising a supporting substrate, a photogenerating layer, a hole transport layer, and wherein said photogenerating layer is comprised of at least one photogenerating pigment, and wherein said photogenerating layer and said hole transport layer include a resin binder; said photogenerating layer is situated between said substrate and said hole transport layer; and a layer in contact with and contiguous to the hole transport layer, and which layer is comprised of a crosslinked polymeric network of an indium tin oxide in an amount of from about 0.1 to about 30 weight percent, an acrylated polyol, a crosslinking component, and a charge transport component, and wherein said acrylated polyol is represented by $$[R_s—CH_2]_t—[—CH_2—R_a—CH_2]_p—[—CO—R_b—CO—]_n—[—CH_2—R_c—CH_2]_p—[—CO—R_d—CO—]_q$$

where $R_s$, represents $CH_2CR_1CO_2$—; wherein t represents the mole fraction acrylic groups on available sites; where $[R_s—CH_2]_t$ can be located in linear or branched portions of $R_a$, $R_b$, $R_c$, and $R_d$; where $R_a$ and $R_c$ independently represent at least one of a linear alkyl group, a linear alkoxy group, a branched alkyl group, and a branched alkoxy group, wherein each alkyl and alkoxy group contain from about 1 to about 20 carbon atoms; $R_b$ and $R_d$ independently represent at least one of an alkyl and alkoxy wherein said alkyl and said alkoxy each contain from about 1 to about 20 carbon atoms; and m, n, p, and q represent mole fractions, such that n+m+p+q=1.

25. A photoconductor in accordance with claim 1 wherein said charge transport layer is comprised of an aryl amine, and said charge transport component is comprised of hole transport compounds.

26. A photoconductor in accordance with claim 1 wherein said indium tin oxide is present in an amount of from about 1 to about 12 weight percent, and contains from about 50 to about 95 percent of indium oxide, and from about 5 to about 50 percent of tin oxide, and wherein the total thereof is about 100 percent.

27. A photoconductor in accordance with claim 1 wherein said charge transport layer comprises at least one of

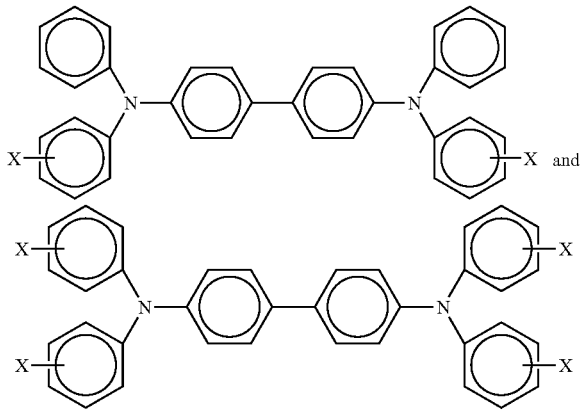

and wherein X is selected from the group consisting of alkyl, alkoxy, and halogen.

28. A photoconductor in accordance with claim 1 wherein said charge transport layer comprises

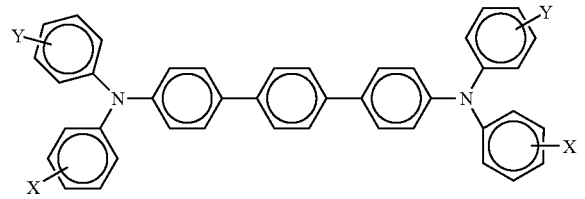

wherein X and Y are independently alkyl, alkoxy, aryl, a halogen, or mixtures thereof.

29. A photoconductor in accordance with claim 1 wherein said charge transport layer comprises a polymer and a compound of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, or N,N'-diphenyl-N,N'-bis(3-chlorophenyl)-[p-terphenyl]-4,4"-diamine.

* * * * *